US005272294A

United States Patent [19]

Charboneau et al.

[11] Patent Number: 5,272,294

[45] Date of Patent: Dec. 21, 1993

[54] PRESSURE VESSEL SYSTEM, PRESSURE RESPONSIVE DEVICE FOR THE SYSTEM, AND METHOD FOR FORMING A DIAPHRAGM FOR THE DEVICE

[75] Inventors: Thomas J. Charboneau, Plainville; Donald J. Chiavaroli, Rehoboth; Patrick F. Meleney, Attleboro, all of Mass.

[73] Assignee: Texas Instruements Incorporated, Dallas, Tex.

[21] Appl. No.: 834,064

[22] Filed: Feb. 10, 1992

[51] Int. Cl.[5] ..... H01H 35/34; H01H 37/36

[52] U.S. Cl. ..... 200/83 R; 200/83 J; 200/83 P

[58] Field of Search ..... 200/83 R, 83 J, 83 P, 200/83 Q, 83 S

[56] References Cited

U.S. PATENT DOCUMENTS

| | | | |
|---|---|---|---|
| 3,984,649 | 10/1976 | Bauer et al. | 200/83 |
| 4,296,287 | 10/1981 | Boulanger et al. | 200/83 P |
| 4,342,887 | 8/1982 | Sanford | 200/83 P |
| 4,400,601 | 8/1983 | Brucken | 200/81.4 |
| 4,459,444 | 7/1984 | Charboneau | 200/83 P |
| 4,581,509 | 4/1986 | Sanford | 200/83 P |
| 4,591.677 | 5/1986 | Hirota et al. | 200/83 J |
| 4,616,114 | 10/1986 | Strasser | 200/83 J |
| 4,633,579 | 1/1987 | Strasser | 29/622 |
| 4,794,214 | 12/1988 | Sanford | 200/83 P |
| 5,123,332 | 6/1992 | Thayer et al. | 92/103 M |

*Primary Examiner*—A. D. Pellinen
*Assistant Examiner*—Michael A. Friedhofer
*Attorney, Agent, or Firm*—Russell E. Baumann; Richard L. Donaldson; René E. Grossman

[57] ABSTRACT

A pressure system has a pressure vessel holding gas under pressure and has a pressure responsive device arranged to be responsive to loss of gas from the vessel to provide a warning signal or the like corresponding to the gas loss. The device has two springs opposing movement of a device diaphragm in response to the gas pressure in the vessel, one spring being arranged to oppose diaphragm movement resulting from change in the gas pressure due to change in gas temperature from a selected temperature in accordance with the gas law, and the other spring being arranged to permit diaphragm movement to change position of a control to provide a signal corresponding to a gas loss when change in the gas pressure in the vessel decreases to a selected level at the selected gas temperature. The cooperation of the two springs permits the device to respond to pressure changes in the vessel which are due to change in gas temperature as well as to any loss of gas which may occur and provides the desired warning signal when loss of gas is sensed at any system temperature within a temperature range likely to be encountered.

26 Claims, 3 Drawing Sheets

PRESSURE VESSEL SYSTEM, PRESSURE RESPONSIVE DEVICE FOR THE SYSTEM, AND METHOD FOR FORMING A DIAPHRAGM FOR THE DEVICE

BACKGROUND OF THE INVENTION

The field of the invention is that of pressure responsive devices, and the invention relates more particularly to a temperature compensated device responsive to change in pressure in a pressure system indicative of a loss of gas from the system at any temperature within a selected temperature range.

Conventional pressure responsive devices arrange a diaphragm to move in response to an applied fluid pressure to actuate a control to provide a signal or perform a related function corresponding to the level of the applied pressure. In a typical device, movement of the diaphragm is normally opposed by a spring which calibrates the device to provide the desired control signal when the applied fluid pressure is at a selected level. Sometimes the diaphragm itself or a member of the control is provided with selected resilience which cooperates with the spring to actuate the control when the applied pressure is at the actuating level. Frequently, however, it is difficult or impossible to calibrate such pressure responsive devices to provide the desired control signal at a precisely predetermined pressure level, and this is particularly true where portions of the applied fluid pressure are attributable to different causes or are subject to different calibration requirements. For example, where a pressure responsive device is intended to sense a loss of gas from a pressure system but where the gas pressure in the system varies with temperature in accordance with the ideal gas law for example, it has not previously been possible to detect the loss of gas from the system with any suitable degree of accuracy. Similarly, where a pressure responsive device is intended to withstand very high pressure levels while also being responsive to small changes in applied pressure, it has been difficult to provide a suitably compact device which meets both high pressure and accurate calibration or pressure sensing requirements.

BRIEF SUMMARY OF THE INVENTION

It is an object of the invention to provide a novel and improved pressure responsive device; to provide such a device which is adapted to be easily and reliably calibrated; to provide such a device which is temperature-compensated; to provide such a device responsive to gas pressure which is adapted to precisely determine when a loss of gas occurs in a closed pressure system while the system is subjected to widely varying temperature conditions; to provide a compact pressure responsive device which is adapted to be subjected to very high levels of applied pressure while being precisely calibrated to sense small changes in the applied pressure; to provide a novel and improved pressure system; to provide such a gas pressure system which is adapted to precisely determine when a loss of gas occurs in the system while the system is subjected to widely varying temperature conditions; and to provide a novel and improved method for forming a metal diaphragm for use in such a pressure device and system.

Briefly described, the novel and improved pressure system of the invention comprises a pressure vessel holding a fluid such as a gas under pressure and includes a novel and improved pressure responsive device arranged to be responsive to changes in the pressure within the vessel. In accordance with the invention, the pressure-responsive device comprises a diaphragm which is mounted on a support to move in response to change in a gas or other fluid pressure applied to the diaphragm. Preferably the diaphragm and the support are formed of metal and are welded together to form an hermetic seal capable of withstanding high pressure forces. A control is also arranged on the support so that a control member such as a switch arm is movable between first and second control positions in response to selected diaphragm movement. The pressure-responsive device also includes first and second springs which normally oppose movement of the diaphragm in response to an applied fluid pressure but which cooperate in permitting sufficient diaphragm movement to move the control member to a control position against its bias under predetermined pressure conditions. Preferably the first and second springs are selected to oppose movement of the diaphragm in response to respective portions of the applied fluid pressure and are individually calibrated to cooperate in determining the applied pressure at which the control member moves between its control positions under different conditions.

In one preferred embodiment of the invention, the pressure-responsive device is arranged in a pressure system so that the device diaphragm is exposed to a gas pressure in a pressure vessel in the system, and the device is temperature-compensated to provide a warning signal or the like at any temperature within a selected range when any loss of gas from the vessel permits the mass of gas in the vessel to fall below a selected minimum. In that device, the first spring comprises a dished bimetal spring which moves from an original to an inverted dished configuration, preferably with a snap-like or overcenter action with a nonlinear spring rate as shown in U.S. Pat. No. 4,861,953 for example, when a selected level of force is applied to one side of the dished spring and which returns to its original dished configuration with corresponding overcenter action when applied force falls below the selected level. The dished spring means is arranged so the diaphragm bears against said one dished spring side and so that the dished spring normally opposes diaphragm movement in response to an applied pressure. The bimetal characteristics of the first spring are selected so that the dished spring is adapted to move to its inverted dished configuration with little or no applied force when the spring is at a selected low temperature such as −40° C. but so that relatively greater force is required to move the dished spring to its inverted dished configuration as the temperature of the dished spring increases up to a second temperature such as 107° C. Preferably the increase in force required to move the first spring to its inverted dished configuration corresponds to or is the same as the increase in gas pressure which occurs in the pressure vessel due to increase in temperature of the gas from −40° C. to 107° C or other temperature range which maybe selected. The second spring preferably comprises a coil spring which is arranged to bear against an opposite side of the dished first spring with a force corresponding to or the same as the force which would balance a gas pressure such as 2000 psi. applied to the diaphragm at the selected low temperature of −40° C. when a desired minimum mass of gas is present in the pressure vessel. The pressure vessel in the system is then provided with a predetermined mass of gas somewhat greater than the desired minimum mass of gas. In that arrangement, the pressure established by the initial mass of gas is sufficient to move the dished bimetal spring to its inverted dished configuration and to move the control member to its second control position. The gas pressure in the vessel is sufficient to retain the control member in its second position even though the temperature of the gas and of the dished bimetal spring varies throughout the temperature range from −40° C. to 107° C. However, if there is any loss of gas from the pressure vessel such that the mass of gas falls below the desired minimum level, the dished bimetal spring returns to its original dished configuration with overcenter action allowing the control member to return to its first control position in response to the control member bias to provide a warning indicating the loss of gas below the minimum level. This is true when the temperature of the gas and of the dished spring is at any temperature within the described temperature range. Typically, for example, the pressure-responsive device is adapted to provide the loss-of-gas warning with substantially equal accuracy when the gas pressure in the vessel is at 2000 psi. at the selected low temperature of −40° C. or when the gas pressure is at 3500 to 4200 psi. or the like at the opposite end of the noted temperature range.

In one preferred embodiment of the pressure responsive device of the invention, the diaphragm is mounted between two metal washers by welding peripheral portions of the washers and diaphragm together. A piston has one end of relatively small diameter disposed against the diaphragm through a bore in one of the washers and has an annular portion of a second, relatively much larger diameter at its opposite end engaging said one side of the dished spring to transfer force and movement from the diaphragm to the dished spring. A force-transmitting member disposed at an opposite side of the dished spring has an annular portion, preferably of said second diameter, disposed against the opposite dished spring side. The second, coil spring has one end bearing against the force-transmitting member to press the force-transmitting member against the dished spring to cooperate in opposing movement of the diaphragm in response to an applied fluid pressure. A motion transfer pin has one end engaging the dished spring and is slidable in the force-transmitting member to move the control member to its second control position when the dished spring moves to its inverted dished configuration. The support preferably comprises a metal sleeve welded to one of the washers mounting the diaphragm and extends around the control and around the first and second springs. Rings are welded to the sleeve at selected locations to bear against a peripheral part of the dished spring and against an opposite end of the coil spring respectively to permit easy and reliable construction and calibration of the device.

In another preferred embodiment of the pressure responsive device of the invention, the second spring comprises a dished monometal spring which is disposed in nested relation with the first dished bimetal spring. In that device, the two springs cooperate in providing a very compact device capable of withstanding very high pressure forces.

In one preferred embodiment of the invention, the diaphragm mounted between the two metal washers is selectively deformed by applying a selected fluid overpressure to the diaphragm through a bore in one washer, thereby to form a depressed central portion of the diaphragm which extends into a bore in the other washer and which has a flat part of selected area bearing against the small diameter end of the piston in that other washer bore. In that arrangement, movement of the diaphragm in response to change in applied gas pressure transfers force more uniformly to the dished first spring because the flat area of engagement between the diaphragm and piston remains relatively constant during such diaphragm movement.

DESCRIPTION OF THE DRAWINGS

Other objects, advantages and details of the novel and improved pressure responsive device, pressure system and method of the invention appear in the following detailed description of preferred embodiments of the invention, the detailed description referring to the drawings in which.

DESCRIPTION OF THE PREFERRED EMBODIMENTS

Figure 1:
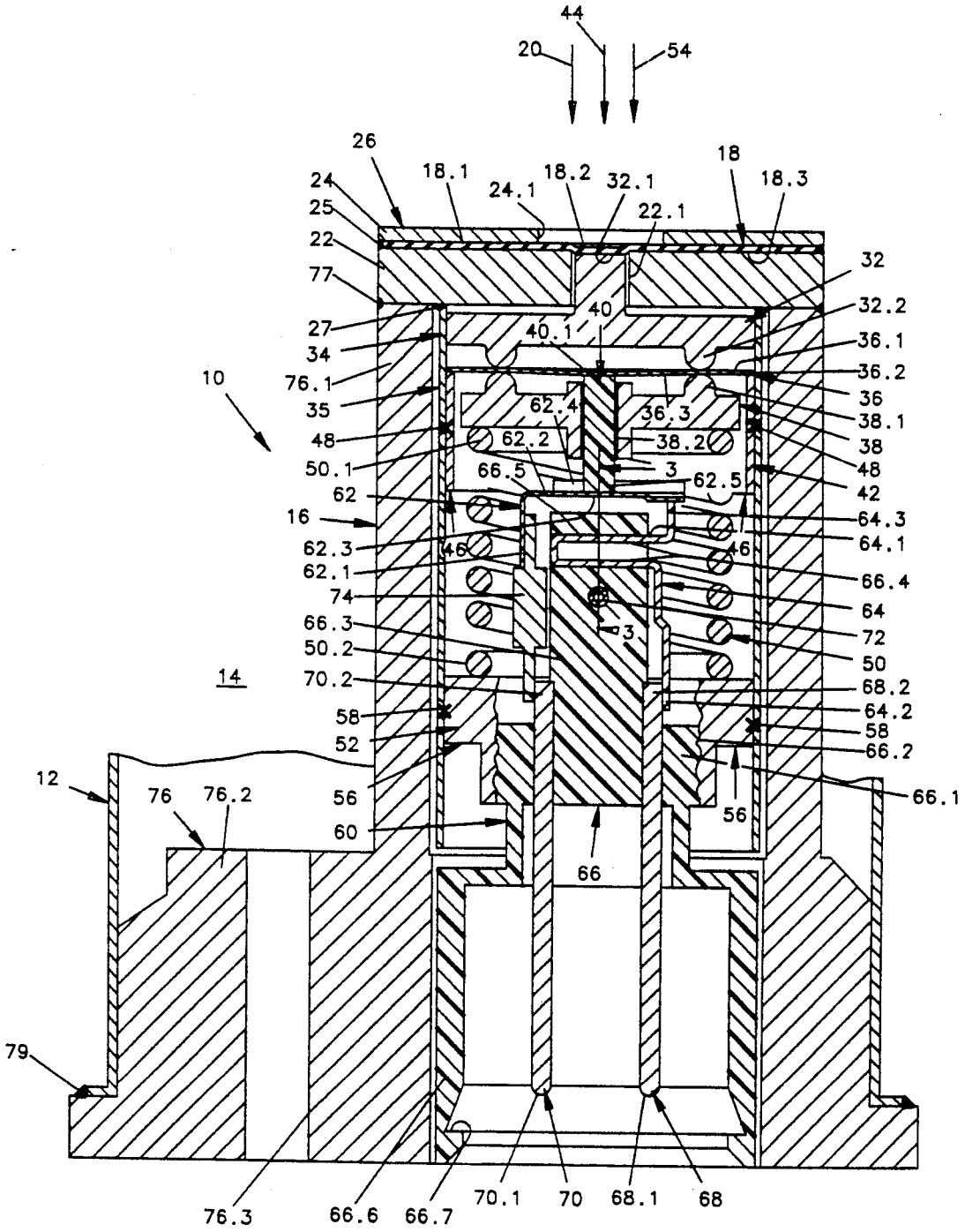
FIG. 1 is a section view along a longitudinal axis of a preferred embodiment of the pressure responsive device of the invention illustrating the device in the pressure system of the invention.
Figure 2:
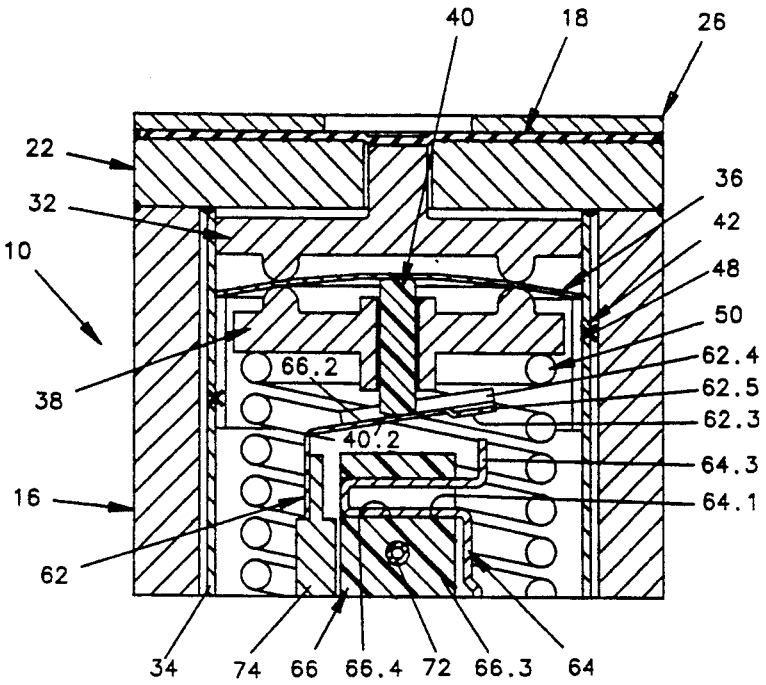
FIG. 2 is a partial section view- similar to FIG. 1 illustrating the device of FIG. 1 in an alternate control position.
Figure 3:
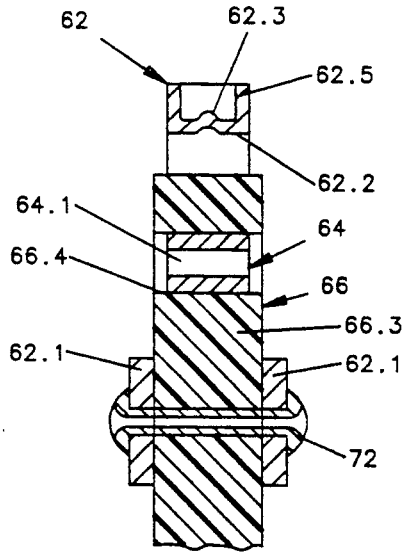
FIG. 3 is a partial section view along line 3—3 of FIG. 1.

Referring to the drawings, 10 in FIGS. 1-3 indicates the novel and improved pressure system of the invention which is shown to include a pressure vessel 12 of any conventional type adapted to hold a fluid 14 such as a gas or liquid under pressure within the vessel and to include a pressure responsive device 16 which is arranged to be responsive to pressure in the vessel to give a warning or indication such as a control signal or the like representative of the pressure in the vessel under different conditions. In a typical embodiment, for example, the pressure system is adapted to inflate an automotive safety air bag or the like of known type, and the fluid in the pressure vessel comprises an inert gas to be used to inflate or supplement inflation of the safety air bag. In that system, the pressure responsive device 16 of the present invention is arranged to monitor the gas level in the pressure vessel to detect any loss of gas from the vessel which may occur over a long service life and to give a warning or control signal or the like when gas loss from the vessel has been sufficient to require refilling or replacement of the pressure vessel in the system. In such an automotive application it will be understood that the temperature of the gas in the vessel is likely to vary over a wide temperature range from −40° C. to 107°. for example and that, in accordance with the ideal gas law (or with the ideal gas law modified for compressibility factors for higher pressures), the gas pressure level within the vessel will vary substantially with the temperature change even though no gas loss occurs. Typically, for example, where the gas pressure level is intended to be maintained at least above 2000 psi. at a selected low temperature such as −40° C.—that pressure level representing a specific desired minimum mass of the gas at that temperature—the pressure level in the vessel will increase up to the level of 3500 to 4200 psi., for example, during gas temperature change up to 107° C. depending on the characteristics of the specific gas used in the vessel. In that regard, the ideal gas law is stated as follows:

$$PV=mRT$$

where P is gas pressure, V is vessel volume, m is mass of the gas, R is the universal gas constant, and T is the gas temperature. Accordingly, the pressure responsive device 16 of the invention is adapted to provide the desired signal when loss of gas is such that the pressure level in the vessel falls below a pressure in the range from 2000 to 4200 psi. or the like depending on the gas temperature at the time when the mass of gas in the vessel falls below the desired minimum level.

In a preferred embodiment of the pressure-responsive device 16, a somewhat resilient metal diaphragm 18 formed of stainless steel or the like is disposed so that one side 18.1 of the diaphragm is exposed to gas pressure in the vessel as indicated by the arrow 20 in FIGS. 1–2. Preferably, for example, a first strong and rigid washer 22 of a metal such as cold rolled or stainless steel or the like is disposed at an opposite side 18.3 of the diaphragm, the first washer preferably having the same outer diameter as the diaphragm and having a bore 22.1 of selected cross-section or diameter, preferably at a central location in the washer. A second strong and rigid washer 24 preferably of the same or similar metal and preferably of the same diameter as the diaphragm is disposed at that outer side 18.1 of the diaphragm. The second washer also has a bore 24.1 aligned with the bore in the first washer. The peripheral portions of the diaphragm and the two washers are then welded together around their peripheries as indicated at 25 to be hermetically sealed together in a common structure 26. A diaphragm structure of this type is shown in the commonly assigned U.S. Pat. No. 4,616,114. Preferably the second washer bore 24.1 is of relatively larger cross-section or diameter than the first washer bore.

In the preferred embodiment of the invention as shown in FIGS. 1–3, a metal sleeve 34, of cold rolled or stainless steel or the like and preferably of relatively smaller outer diameter than the diaphragm structure 26, is secured to the first washer 22, preferably by welding as indicated at 27, to cooperate with the diaphragm structure to form a general device support 35. The sleeve is aligned, preferably coaxially, with the washer bores 22.1, 24.1. The sleeve is preferably thin-walled to permit easy welding thereto as described below and to provide the sleeve with a substantial interior volume.

Figure 6:
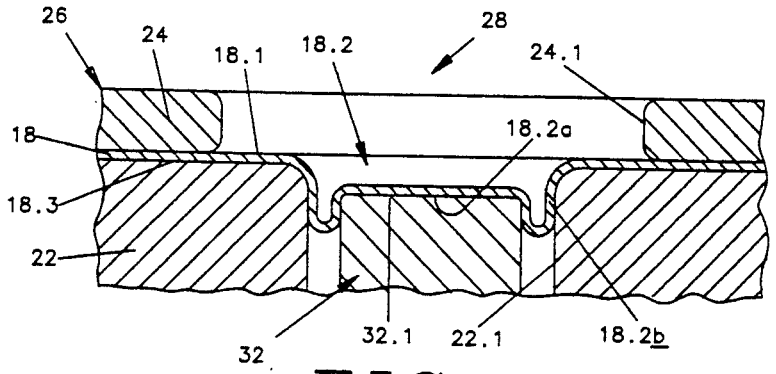
FIG. 6 is a partial section view to enlarged scale similar to FIG. 1 illustrating the method provided by the invention for forming a diaphragm to be used in the device of FIG. 1.

In a preferred embodiment of the invention, the diaphragm structure 26 as above-described is initially subjected to a selected fluid overpressure as indicated by the arrow 28 in FIG. 6 while a back-up element such as the piston 32 having a flat end 32.1 as described below is firmly held in position in the first washer bore 22.1. The overpressure is applied so that a portion 18.2 of the diaphragm, preferably at the center of the diaphragm, is depressed from the diaphragm to extend a predetermined distance into the first washer bore 22.1 to provide a flat lower bearing surface part **18.2*a* connected to the remainder of the diaphragm by a part 18.2*b* of somewhat U- or J-shaped cross-section as shown in FIG. 6. The overpressure is then removed. With that diaphragm deformation, the flat bearing surface part 18.2*a* of the diaphragm is adapted to move along the axis of the first washer 22.1 by unrolling or extension of the U- or J-shaped part of the diaphragm in response to fluid pressure subsequently applied to the diaphragm without substantial change in the surface area of the bearing part 18.2*a* for a purpose to be described below. Preferably the resilience of the diaphragm is selected t be insignificant (relative to the springs 36 and 50** hereinafter discussed) in opposing movement of the diaphragm in response to an applied fluid pressure.

In the preferred embodiment of the device 16, a piston 32 of a strong, rigid metal material or the like (as previously used in forming the diaphragm) is disposed within the sleeve to bear against the diaphragm 18. Preferably the piston has one end 32.1 of a diameter just a little smaller than the diameter of the first washer bore 22.1 which extends part way into the bore 22.1 to be engaged by the bearing part **18.2*a* of the central depressed portion of the diaphragm. The piston also has an annular portion 32.2 of selected relatively larger diameter disposed at an opposite end of the piston. A first, dished spring 36, preferably formed of a bimetal material (only one layer of which is shown for clarity of illustration) is also disposed in the sleeve so that the annular portion 32.2 of the piston engages one side 36.1 of the dished spring, preferably near but somewhat spaced from the periphery 36.2 of the dished spring. Preferably a force-transmitting member 38 is also disposed in the sleeve so that an annular portion 38.1 at one end of the force-transmitting member, preferably of the same diameter as the annular portion 32.2 of the piston, engages an opposite side 36.3 of the dished spring. Preferably the force-transmitting member has a central bore 38.2 slidably receiving a motion transfer pin 40 of an electrically insulating, ceramic material or the like in the bore 38.2 so that one end 40.1 of the pin bears against the dished spring side 36.3. A first thin metal ring 42 of cold rolled or stainless steel or the like is also disposed in the sleeve. The outer diameters of the piston, dished spring, force-transmitting member and ring are preferably selected relative to each other and to the inner diameter of the sleeve 34 so that the piston and dished spring are axially movable within the sleeve as guided by the sleeve so that the ring fits snugly in the sleeve and is adapted to engage the periphery of the dished spring to limit such axial movement of the piston and dished spring, and so that the force-transmitting member is axially movable within the ring 42**.

The dished bimetal spring 36 is of a conventional type which is adapted to move from an original dished configuration as shown in FIG. 2 to an inverted dished configuration as shown in FIG. 1, preferably with a snap-like or overcenter action with a nonlinear spring rate as shown in U.S. Pat. No. 4,861,953, when sufficient force is applied to one side 36.1 of the spring. Preferably the dished bimetal spring is also adapted to return to its original dished configuration with snap action when corresponding overcenter action applied force is reduced below a selected level. The force required to move the dished bimetal spring to its inverted dished configuration varies with the temperature of the dished spring in the manner conventional with such dished bimetal springs. Preferably the bimetal characteristics of the dished spring 36 are selected so that very little or substantially no force is required to move the dished spring between its original and inverted dished configurations when the dished spring is at a selected low temperature such as −40° C. for example, but so that relatively much greater force is required to move the dished spring to between its original and inverted dished configuration as the dished spring temperature is increased up to 107° C. for example. Preferably the dished spring is selected so that the increase in force required to move the dished spring to its inverted dished configuration at 107° C. is substantially the same as the increase in force applied to the dished spring via the diaphragm 18 and piston 32 due to increase in the temperature of the gas in the pressure vessel 12 up to the temperature of 107° C. Typically dished spring characteristics are selected so that the change in force required to move the dished spring to its inverted dished configuration is linear with respect to the change in pressure applied to the diaphragm as the gas temperature increases to 107° C. e.g.

In assembly and partially calibrating the device 16 as thus far described, a predetermined calibrating pressure is applied to the diaphragm 18 as indicated by the arrow 44 in FIG. 1. Preferably, for example, the calibrating pressure is selected so that, at the calibrating temperature, the calibrating pressure equals or is proportional to that portion of the pressure which would be applied to the diaphragm by the intended minimum mass of gas in the pressure vessel 12 due to increase in the gas temperature from −40° C. up to the calibrating temperature. A force is then applied to the ring 42 as indicated by the arrows 46 (using a tool not shown) to press the ring 42, the dished spring, and the piston toward the diaphragm 18 until reaction force from the diaphragm moves the dished spring to its inverted dished configuration. The ring 42 is then secured in its position in sleeve 24, preferably by resistance welding or the like as indicated 48.

A second spring 50 of the coil spring type is also disposed in the sleeve so that one end 50.1 of the coil spring bears against the force-transmitting member opposite the annular portion 38.1 on the force-transmitting member to further press the annular portion 38.1 against the side 36.3 of the dished spring. A second metal ring 52 is then disposed in the sleeve to bear against the opposite end 50.2 of the coil spring. In assembling and further calibrating the device 16 as thus far described, another predetermined calibrating pressure is applied to the diaphragm 18 as indicated by the arrow 54 in FIG. 1. Preferably, for example, this calibrating pressure is selected so that, at the calibrating temperature, the calibrating pressure 54 equals or is proportional to the pressure which would be applied by the intended minimum mass of gas in the pressure vessel 12 at the calibrating temperature. A force is then applied to the ring 52 as indicated by the arrows 56 (using a tool not shown) to press the ring 52, the coil spring 50, the force-transmitter 38, the dished spring 36 and the piston 32 toward the diaphragm 18 until reaction force from the diaphragm snaps the dished spring to its inverted dished configuration. The ring 52 is then secured in its position in the sleeve, preferably by resistance welding or the like as indicated at 58.

A control 60 having a control member 62 which is movable between first and second control positions is also mounted on the device support so that the control member is moved between its control positions in response to movement of the device diaphragm. Preferably, for example, the control comprises an electrical switch wherein a first movable control or switch member comprises a movable contact arm 62 as shown in FIGS. 1-3. Preferably the movable contact arm is resilient to be inherently biased to move to a first or open circuit position spaced from a second control or switch element such as a complementary contact 64 as shown in FIG. 2 but is adapted to be moved against its inherent bias to a second or closed circuit position engaging the complementary contact as shown in FIG. 1. Alternately if desired, the control comprises a valve or other conventional motion-responsive component within the scope of the invention. If desired, the control 60 is attached to the support by use of a third metal ring (not shown) which is also welded to the sleeve 34, the third ring being secured to the sleeve by welding or the like to position the control member 62 to be held in its second control position engaging the complementary contact 64 with selected contact engagement force when the dished spring is in its inverted dished configuration. Preferably, however, the control 60 is adjustably mounted on the second ring 52 to be axially movable within the sleeve to position the control member 62 in its second position with desired contact pressure when the dished spring is in its inverted dished configuration.

In a preferred embodiment of the device 16, the control 60 comprises a body 66 of a ceramic or organic material of electrically insulating properties having a relatively large cross-section portion 66.1 threadedly attached as at 66.2 to the second metal ring 52. A pair of electrically conductive terminals 68, 70 are mounted on the body extending through the body portion 66.1 so that first terminal ends 68.1,70.1 are accessible from outside the device 16 while opposite terminal ends 68.2,70.2 are disposed within the sleeve 34 adjacent to respective opposite sides of an integral, relatively smaller cross-section portion 66.3 of the body. Preferably the body has a recess 66.4 in one side of the small body portion. The second or complementary control or switch contact element 64 comprises a thin strip of resilient electrically conductive metal having a bight 64.1 intermediate its ends. One end 64.2 of the complementary contact is secured in electrically conductive relation to on of the terminals 68 preferably by welding and the bight 64.1 is snugly accommodated in the body recess 66.4 to dispose an opposite end 64.3 of the complementary contact upstanding from one end 66.5 of the body. In that arrangement, the complementary contact is stiffly supported against twisting by the bight but is easily flexed by a force applied along the axis of the upstanding end of the complementary contact to provided a desired limit to contact pressure between the movable contact arm 62 and the complementary contact 64. Preferably the movable contact member 62 is also formed of a strip of resilient electrically conductive metal having one end 62.1 of U-shape fitted around the smaller body portion 66.3 and having an opposite arm portion 62.2 extending generally at a right angle to the first end to overly the body end 66.5 and be normally biased by its inherent resilience away from the complementary contact 64 but to be movable into electrical engagement with the complementary contact. Preferably any force applied to the diaphragm 18 by the resilience of the contact member 62 is selected to be insignificant relative to the forces applied by the spring 36 and by the coil spring 50. Preferably the legs of U-shape of the movable contact member end 62 are secured to the body portion 66.3 by any conventional means such as a rivet 72. Preferably an electrical resistance element 74 of selected value is secured in electrically connected relation to the movable member 62 and to the other terminal 70 to be in series therewith in closely spaced relation to the point of engagement between the movable and complementary contacts 62, 64. Preferably the movable contact member has a dimple 62.3 in the arm end to be engaged by an opposite end 40.2 of the motion transfer pin 40 and preferably the arm has stiffening flange 62.4 and rib 62.5 portions. In assembling and completing calibration of the device 16, the control member 60 is rotated in its threaded engagement with the metal ring 52 to axially advance the control member in the sleeve so that, with the dished spring 36 in its inverted dished configuration, the movable contact arm is engaged with the pin 40 and moved into engagement with the complementary contact 64 sufficient to flex the bight 64.1 to provide the desired level of contact engagement between contacts 62 and 64. The construction of the control 60 as thus described permits this rotation to be accomplished without twisting of the contact members. If desired, the threaded engagement of the control with the ring 52 is then fixed by staking or by application of an epoxy or the like to the threads 66.2 as will be understood. Preferably the control body has a shield part 66.6 protecting the terminals 68, 70 and preferably has a notch 66.7 in the shield part for detachably retaining a connector (not shown) attached to the terminals.

Preferably the pressure responsive device 16 includes the components as above described. The device is then adapted for mounting in different applications by addition of a mount or other housing 76 adapted for the specific applications. Preferably, for example, a metal housing member 76 having the general configuration of a tube has one end 76.1 welded or otherwise secured in hermetically sealed relation to the periphery of the diaphragm structure 26 as indicated at 77 and has a flange 76.2 at its opposite end welded or otherwise secured in hermetically sealed relation as indicated at 79 to the pressure vessel 12. If desired, the flange 76.2 includes a port 76.3 to receive a valve or the like (not shown) for filling the pressure vessel with gas or other fluid as desired.

Figure 4:
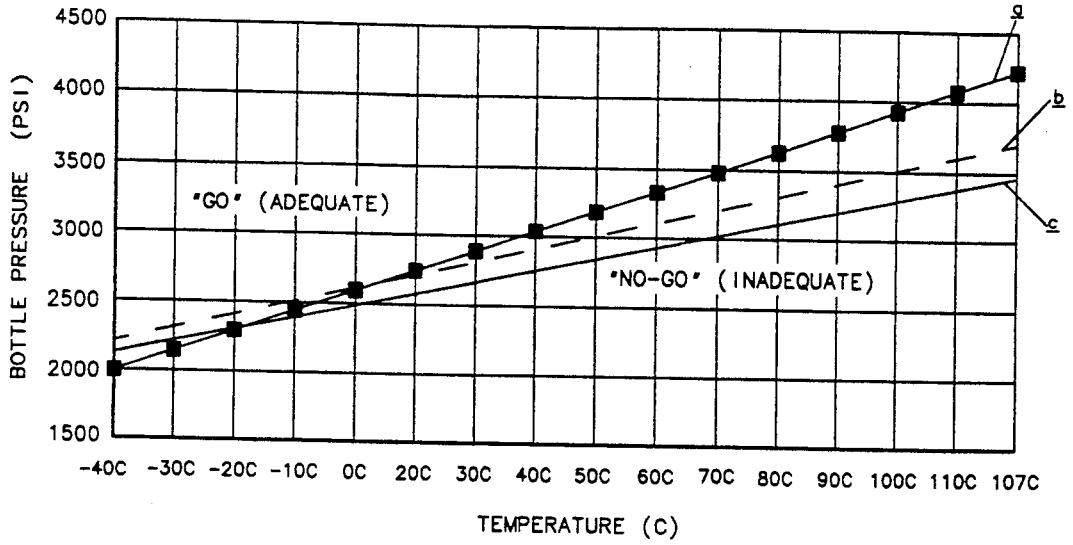
FIG. 4 is a graph illustrating performance of the device shown in FIG. 1.

In that arrangement of the device 16 in the pressure system 10, a selected mass of gas relatively greater than the desired minimum mass of gas is provided in the pressure vessel 12. Accordingly, the pressure of that gas against the device diaphragm 18 is sufficient to move the dished spring 36 to its inverted dished configuration to electrically engage the movable control member 62 with the complimentary control member 64 with selected contact engagement pressure to provide an electrical signal across the device terminal 68,70 as shown in FIG. 1. The engagement of the annular portions 32.2 and 38.1 of the piston and force-transmitting member with the dished spring 36 near the periphery of the dished spring provides the diaphragm 18 with substantial support even against very high fluid pressures in the vessel 12 so that there is no tendency for the high pressures to cause excessive bending of the control members 62 and 64. The presence of the resistance element 74 in series with the movable control member 62 close to its point of engagement with the complementary control member 64 permits the signal across the device terminals to be sensed to provide a signal value representing proper closing of the control contacts and to distinguish that proper closing from any possible short circuiting which may occur across the device terminals. The control 60 is retained in its second control position by the applied gas pressure even though the gas pressure in the vessel 12 varies over a wide range due to change in the gas temperature over a temperature range from −40° C. to 107° C. so long as the minimum desired mass of gas is retained in the pressure vessel. However, if sufficient gas is lost from the pressure vessel by leakage or the like over a long service life or by catastrophic failure of the pressure vessel or of an hermetic seal so that the minimum desired mass of gas is no longer present in the vessel, the dished spring moves with overcenter action back to its original dished configuration as shown in FIG. 2 to permit the control members 62 and 64 to separate response to the bias of the control member 62, thereby to interrupt the electrical signal provided by the device 16 to give warning of the gas loss. That switch-opening movement of the dished spring 36 is adapted to occur at selected different gas pressure levels in the vessel 12 as indicated by a curve a in FIG. 4 depending on the gas temperature at the time loss of gas below the minimum desired mass level occurs. That is, as shown in FIG. 4, the device 16 is adapted to indicate the gas loss at 2000 psi. pressure when the gas is at a temperature of −40° C. or at a pressure of 4200 psi. when the gas is at a temperature of 107° C. Alternately, by selection of a different gas or gas volume, by selection of springs 36 and 50 of different properties, by change of the relative diameters of the annual portions of the piston and force-transmitting member, or by change in the calibration of the device 16 or the like, the performance characteristics of the device 16 are adapted to be varied as desired as indicated by curves b and c in FIG. 4. The particular arrangement of the deformed central portion 18 of the diaphragm is such that the area of engagement between the piston 32 and the flat bearing surface 18.2*a* of the diaphragm does not change substantially during movement of the diaphragm in response to an applied pressure so that the piston ratio of the device does not change substantially during the diaphragm movement.

It should be understood that various modifications of the pressure system and pressure responsive device are possible within the scope of the present invention. For example, in an alternate embodiment of the invention, the dished spring 36 is formed of a monometal material and the characteristics of the spring are selected so that the dished spring opposes a major portion of an applied fluid pressure. The second spring 50 is then selected to oppose a relatively much smaller part of the applied fluid pressure. In that arrangement, the dished spring is adapted to support the diaphragm 18 against a very high applied fluid pressure in a very compact manner while the second spring is easily mounted to provide close and precise calibration of the device to be actuated in response to small change in the applied fluid pressure.

It should also be understood that the pressure responsive device shown in a normally-open circuit structure is also adapted to be modified in conventional manner to provide a normally-closed circuit structure.

Figure 5:
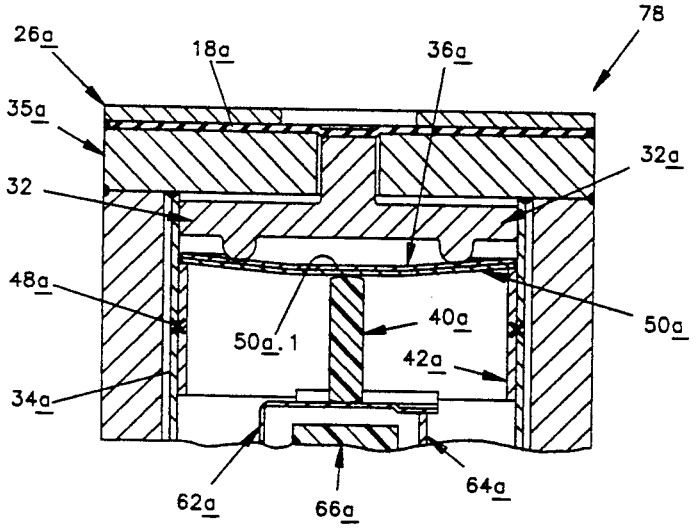
FIG. 5 is a partial section similar to FIG. 1 illustrating another preferred embodiment of the pressure responsive device of the invention.

In another preferred embodiment of the pressure responsive device of the invention as indicated at 78 in FIG. 5, wherein corresponding reference numerals indicate corresponding device components, the second spring 50*a* also comprises a dished spring which is movable from an original dished configuration to an inverted dished configuration with overcenter action when a selected force is applied to one side 50*a*.1 of the second spring. The second spring is also adapted to return to its original dished configuration with overcenter action when the force applied to the dished spring side 50*a*.1 falls below the selected force level. The dished second spring is mounted in the device in nested relation to the first dished spring 36*a* so that the peripheries of both of the dished springs are in effect supported by the first metal ring 42*a*. In that arrangement, the first dished spring 36*a* is adapted to be formed either of a bimetal or a monometal material as desired to perform functions of the first spring 36 as specified in either of the device embodiments previously discussed, and the second dished spring is selected to perform the function of the coil spring 50 previously discussed. That is, when the pressure applied to the diaphragm is sufficient to cause movement of the two dished springs to their inverted dished configurations with overcenter action, a motion transfer member 40*a* moves in response to the dished spring movement to move a device control member between control positions. The use of two dished springs permits the device 78 to be of a very compact structure while meeting all of the performance requirements of the previously described embodiments of the invention. The device 78 is calibrated by selection of the properties of the dished springs relative to each other or by other means conventionally employed for calibrating dished springs of the type described.

It should be understood that although particular embodiments of the system, device and method of the invention have been described by way of illustrating the invention, the invention includes all modifications and equivalents of the described embodiments falling within the scope of the appended claims.

We claim:

1. A pressure responsive device comprising a support, a diaphragm mounted on the support to move in response to a fluid pressure applied to the diaphragm, a control mounted on the support and having a control member movable between first and second control positions, the control member being biased to the first control position, a first spring mounted on the support to oppose movement of the diaphragm in response to the fluid pressure, said first spring being a thermostatic bimetallic member having a temperature sensitivity selected to oppose movement of the diaphragm in response to change in an applied gas fluid pressure which is due to change in gas temperature from a selected temperature, and a second spring mounted on the support to oppose movement of the diaphragm in response to the fluid pressure, said second spring being selected to permit sufficiently diaphragm movement to move the control member to the second control position when a change in the applied gas fluid pressure reaches a selected level at said selected temperature, the first and second springs being arranged to respond to moving of the diaphragm to move control member from the first to the second control position against the bias and cooperating to determine the applied fluid pressure which effects sufficient diaphragm movement to move the control member to the second control position.

2. A pressure responsive device according to claim 1 wherein the first spring opposes movement of the diaphragm in response to one predetermined portion of an applied fluid pressure, and the second spring opposes movement of the diaphragm in response to another predetermined portion of the applied fluid pressure.

3. A pressure responsive device according to claim 2 wherein the first spring is selected to oppose a major portion of the applied fluid pressure, and the second spring is mounted on the support to be adjusted relative to the first spring to determine within a selected range the applied fluid pressure which moves the diaphragm to a sufficient extent to move the control member to the second control position.

4. A pressure responsive device according to claim 2 wherein the thermostatic bimetallic member comprises a dished element which is movable from an original dished configuration to an inverted dished configuration with overcenter action in response to application of a selected force to one side of the element, the dished element is mounted on the support to receive force on one element side from the diaphragm in response to a fluid pressure applied to the diaphragm, the dished element and the second spring are mounted on the support relative to each other to permit selected diaphragm movement to move the control member to the second control position, and the dished element is proportioned to permit said selected diaphragm movement to occur during movement of the dished element to its inverted dished configuration and thereafter cooperate with the second spring to oppose further diaphragm movement in response to the applied fluid pressure.

5. A temperature-compensating pressure responsive switch device comprising a support; a resilient metal diaphragm mounted on the support to move in response to change in a gas pressure applied to the diaphragm; an electrical switch mounted on the support having a resilient switch member movable between first and second switch positions, the resilient switch member being biased toward the first switch position; a dished bimetal spring movable between original and inverted dished configurations with overcenter action in response to change in a force applied to one side of the dished spring, the dished spring being mounted on the support to receive force from the diaphragm on said one dished spring side in response to said applied gas pressure; and a second spring mounted on the support to receive force from the diaphragm in response to the applied gas pressure; the dished and second springs being responsive to selected diaphragm movement to permit snap acting dished spring movement to move the resilient switch member to the second switch position against its bias; the dished and second springs cooperating to determine the applied gas pressure which is effective to provide said selected diaphragm movement; the dished spring being responsive to change in temperature from a selected temperature to oppose diaphragm movement resulting from a concomitant change in the applied gas pressure due to change in gas temperature from the selected temperature; and the second spring being selected to permit said selected diaphragm movement when the applied gas pressure reaches a selected level at said selected gas temperature.

6. A pressure-responsive switch device according to claim 5 wherein a piston has one end disposed against the diaphragm and has an annular opposite end portion disposed against said one side of the dished spring, a ring secured to the support engages a peripheral part of the dished spring, and the second spring bears against an opposite side of the dished spring to cooperate with the dished spring to oppose diaphragm movement in response to applied gas pressure.

7. A pressure-responsive switch device according to claim 6 wherein the annular piston portion engages said one dished spring side closely adjacent the peripheral part of the dished spring, and a force transmitting member has an annular portion bearing against the opposite dished spring side, the second spring bearing against the force transmitting member to cooperate with the dished spring to oppose diaphragm movement in response to the applied gas pressure.

8. A pressure-responsive switch device according to claim 7 having a motion transfer pin movable with said snap-acting movement of the dished spring to move the switch member to the second switch position in response to overcenter movement of the dished spring.

9. A pressure-responsive switch device according to claim 8 wherein the annular portions of the piston and the force-transmitting members have the same diameter and engage respective sides of the dished spring closely adjacent the peripheral part of the dished spring so that the dished spring cooperates with the second spring in limiting further diaphragm movement after said overcenter movement of the dished spring.

10. A pressure-responsive switch device according to claim 5 wherein the electrical switch comprises a complementary contact to be electrically engaged by the resilient switch member in one of said switch positions, and the electrical switch is secured to the support so that the resilient switch member electrically engages the complementary contact in said one switch position and is spaced from the complementary contact in the other switch position.

11. A pressure-responsive switch device according to claim 10 wherein a first ring secured to the support engages a peripheral part of the dished spring, the second spring comprises a coil spring having one end bearing against an opposite side of the dished spring to cooperate with the dished spring to oppose diaphragm movement in response to applied gas pressure, and a second ring secured to the support engages an opposite end of the coil spring.

12. A pressure-responsive switch device according to claim 11 wherein the electrical switch is secured to the second ring to be secured to the support.

13. A pressure-responsive switch device according to claim 12 wherein the electrical switch is adjustably mounted on the second ring to selectively position the stationary contact to be electrically engaged by the resilient switch member with at least a selected force in said one switch position and to be spaced from the resilient switch member in the other switch position.

14. A pressure-responsive switch device according to claim 13 wherein the complementary contact cooperates with the dished spring and the second spring in limiting further diaphragm movement after said snap-acting movement of the dished spring.

15. A pressure-responsive switch device according to claim 5 wherein the support comprises a first washer of a first diameter having a first side disposed at one side of the diaphragm, a second washer of said first diameter disposed at an opposite side of the diaphragm, the first and second washers having peripheral parts thereof welded in sealed relation to a peripheral part of the diaphragm, and a sleeve welded to an opposite side of the second washer extends in surrounding relation to the dished spring, to the second spring, and to the electrical switch.

16. A pressure-responsive switch device according to claim 15 wherein a piston has one end extending into a bore in the second washer to bear against the diaphragm and has an annular portion at its opposite end disposed against said one side of the dished spring, a ring is secured to the sleeve within the sleeve to engage a peripheral part of the dished spring, and the second spring bears against an opposite side of the dished spring to cooperate with the dished spring to oppose diaphragm movement in response to gas pressure applied to the diaphragm through a bore in the first washer.

17. A pressure-responsive switch device according to claim 16 wherein the annular piston portion engages said one dished spring side closely adjacent the peripheral part of the dished spring, a force transmitting member has an annular portion bearing against the opposite dished spring side, a second ring is secured to the sleeve within the sleeve, and the second spring comprises a coil spring having one end bearing against the force-transmitting member and an opposite end engaging the second ring to cooperate with the dished spring to oppose diaphragm movement in response to the applied gas pressure.

18. A pressure-responsive switch device according to claim 17 wherein the electrical switch comprises a complementary contact to be electrically engaged by the resilient switch member in one of said switch positions, the electrical switch is adjustably mounted on the second ring to selectively position the complementary contact and resilient switch member relative to the dished spring, and a motion-transfer pin is slidably mounted in a bore in the force-transmitting member to be movable with said snap-acting movement of the dished spring to move the resilient switch member to the second switch position in response to snap-acting movement of the dished spring.

19. A pressure-responsive switch device according to claim 17 wherein a second metal sleeve has one end welded in sealed relation to the second washer and extends in surrounding relation to the first sleeve, the second metal sleeve having a flange at its opposite end to be welded to a wall of a pressure vessel to mount the switch device on the pressure vessel with the device extending into the vessel.

20. A pressure-responsive switch device according to claim 16 wherein the diaphragm has a depressed central portion defining a bearing surface of selected area in engagement with said one end of the piston, the depressed central portion of the diaphragm being movable in response to change in gas pressure applied to the diaphragm while maintaining the selected area of said bearing surface in engagement with said one piston end constant during the diaphragm movement.

21. A pressure-responsive switch device according to claim 5 wherein the second spring comprises a dished metal spring movable from an original to an inverted dished configuration with overcenter action in response to application of a second selected force to one side of the second dished spring, the second dished spring being disposed in nested relation with the dished bimetal spring to oppose movement of the diaphragm in response to applied gas pressure, and a ring secured to the support engages a peripheral part of one of the nested springs to position the nested springs relative to the diaphragm and the electrical switch to respond to selected diaphragm movement to permit overcenter movement of the dished springs to move the resilient switch member to the second switch position.

22. A pressure responsive switch device according to claim 5 wherein the resilient switch member first-named above is movable between an open switch position spaced from a complementary switch member and a closed circuit position engaging the complementary switch member; the switch comprises an electrically insulating body threadedly attached to the support to adjustably position the switch on the support by rotation of the body on the support; the body has a recess extending into the body from one body side; the complementary switch member embodies a strip of resilient electrically conductive metal having a bight between its ends; and the bight is snugly accommodated in the body recess to dispose one end of the complementary switch member extending from an end of the body to be selectively engaged by the first-named switch member, to permit movement of said one end of the complementary switch member toward the body recess by flexing of the bight in the recess in response to engagement by the first-named switch member to determine the pressure of engagement therebetween, and to support the complementary switch member to prevent twisting thereof during rotation of the insulating body.

23. A pressure-responsive switch device according to claim 22 wherein a pair of terminals are mounted on the body to extend from an end of the body in spaced insulated relation to each other, the complementary switch member is mounted at one side of the body connected to one of the terminals to dispose said one end of the complementary switch member extending from an opposite end of the body, and the first named switch member is mounted on the body connected to the other of said terminals, the first named switch member having a resilient arm extending over said one body end to be moved into and out of engagement with said one end of the complementary switch member.

24. A pressure-responsive switch device according to claim 23 wherein the first-named switch member has a U-shaped portion disposed around three other sides of the insulating body supporting the resilient member arm over said one end of the body.

25. A pressure-responsive switch device according to claim 24 having an electrical resistance element of relatively greater electrical resistance than the switch terminals and members disposed in series with the switch members closely adjacent to the location of engagement of the members at said one body end to provide the switch with a selected switch resistance in closed switch position characteristic of the switch in properly closed circuit position.

26. A pressure system comprising a pressure vessel having a chamber holding gas under pressure; and a pressure responsive switch device for sensing selected loss of gas from the chamber, the pressure responsive device comprising a support attached to the vessel, a resilient metal diaphragm mounted on the support to move in response to change in gas pressure in the chamber, an electrical switch having a resilient switch member movable between first and second switch positions and having a bias toward the first switch position, a dished bimetal spring movable between original and inverted dished configurations with snap action in response to change in a force applied to one side of the dished spring, the dished spring being mounted on the support to receive force from the diaphragm on said one side in response to the gas pressure applied to the diaphragm, and a second spring mounted on the support to receive force from the diaphragm in response to the gas pressure applied to the diaphragm, the dished and second springs being responsive to selected diaphragm movement to permit snap acting dished spring movement to move the switch member to the second switch position against its bias, the dished and second springs cooperating to determine the gas pressure in the chamber which is effective to permit the selected diaphragm movement, the dished spring being responsive to change in gas temperature from a selected temperature to oppose diaphragm movement resulting from a concomitant change in gas pressure in the chamber due to change in the gas temperature from the selected temperature, the second spring being selected to permit the selected diaphragm movement when loss of gas from the chamber reduces gas pressure in the chamber to a selected level at the selected temperature.

* * * * *